United States Patent [19]

Fukatsu

[11] Patent Number: 4,739,296

[45] Date of Patent: Apr. 19, 1988

[54] CURRENT TRANSFORMER COOLED BY A CIRCULATING DIELECTRIC FLUID

[75] Inventor: Takeo Fukatsu, Amagasaki, Japan

[73] Assignee: Mitsubishi Denki Kabushiki Kaisha, Tokyo, Japan

[21] Appl. No.: 939,804

[22] Filed: Dec. 9, 1986

[30] Foreign Application Priority Data

Dec. 16, 1985 [JP] Japan ..... 60-284623

[51] Int. Cl.[4] ..... H01F 27/08; H01F 40/06

[52] U.S. Cl. ..... 336/62; 174/15 BH; 174/15 C; 336/174; 336/223

[58] Field of Search ..... 336/62, 55, 223, 173, 336/174, 175; 219/10.51; 174/15 BH, 16 BH, 15 C; 138/40, 44

[56] References Cited

U.S. PATENT DOCUMENTS 3,299,383 1/1967 Conner et al. ..... 336/62 X
3,686,598 8/1972 Ozawa et al. ..... 336/62 X
3,697,914 10/1972 Khrenor et al. ..... 336/62
4,467,306 8/1984 Morishita ..... 336/62 X

*Primary Examiner*—Thomas J. Kozma

[57] ABSTRACT

A current transformer has a hollow tube made from an electrical conductor which is bent at its center so as to form a loop which functions as a primary winding and two parallel straight portions at the ends of the tube which function as leads for the primary winding. The tube has a longitudinally-extending fluid-carrying passageway for a dielectric fluid formed at its center. Both ends of the tube are open and communicate with the inside of a reservoir for a dielectric fluid. A longitudinally-extending electrically-insulating member is inserted into the fluid-carrying passageway of one of the straight portions of the tube so as to decrease the cross-sectional area of the passageway in that portion and increase its resistance to flow. The increase in flow resistance produces a temperature difference within the tube, promoting circulation of the dielectric fluid by convection.

1 Claim, 4 Drawing Sheets

CURRENT TRANSFORMER COOLED BY A CIRCULATING DIELECTRIC FLUID

BACKGROUND OF THE INVENTION

This invention relates to a current transformer, and more particularly it relates to a self-cooled, high-voltage current transformer which is cooled by the circulation of a dielectric fluid through a tubular primary conductor.

It is well-known in the art to cool the primary winding of a high-voltage current transformer by the provision of cooling passages within the primary winding through which a dielectric fluid is made to circulate by convection. The general structure of this type of self-cooled current transformer is illustrated in FIGS. 1 through 3 of the attached drawings, which show a current transformer disclosed in Japanese Published Patent No. 43-3129 (1968). FIG. 1 is a vertical cross-sectional view thereof, while FIGS. 2 and 3 are enlarged transverse cross-sectional views taken along Line II—II and Line III—III, respectively, of FIG. 1. As shown in the figures, a primary conductor 1 of the current transformer comprises a straight portion and an annular portion. The straight portion comprises an inner tubular conductor 2 and an outer tubular conductor 3 which is concentrically disposed with respect to the inner conductor 2. The inner conductor 2 is longer than the outer conductor 3 and extends past both ends of the outer conductor 3. The outer surface of the inner conductor 2 is conveyed by an electrically-insulating tube 4 which electrically insulates the inner conductor 2 and the outer conductor 3 from one another. The annular portion of the primary conductor 1, which serves as a primary winding, comprises an annular conductor 6 which has two parallel channels 5 formed in one surface. The annular conductor 6 is bent into roughly the shape of the letter C with the channels 5 on the outside thereof. One end of the annular conductor 6 is welded or brazed to the bottom end of the outer conductor 3 while the other end is similarly connected to the bottom end of the inner conductor 2 so that the channels 5 of the annular conductor 6 communicate with the insides of the inner and outer conductors 2 and 3. The entire outer surface of the primary conductor 1 is electrically insulated by main electrical insulation 7. The annular conductor 6 is interlinked with a laminated core 8 around which a secondary winding 9 is wrapped. The secondary winding 9 is electromagnetically coupled with the annular portion 6 of the primary conductor 1 so that a current flowing through the primary conductor 1 will induce a secondary current in the secondary winding 9.

The open upper ends of the inner and outer conductors of the primary conductor 1 are disposed inside an unillustrated tank filled with a dielectric fluid so that the dielectric fluid can flow through the entire length of the primary conductor 1. The outer conductor 3 is designed to have a lower current density than the inner conductor 2, with the result that when a current flows through the primary conductor 1 during operation of the transformer, the temperature of the inner conductor 2 is higher than that of the outer conductor 3. This temperature difference produces convection of the dielectric fluid within the primary conductor 1. Namely, as shown by the arrows in FIG. 1, the dielectric fluid flows downwards from the unillustrated tank and enters the space between the inner conductor 2 and the outer conductor 3, flows down the length of the outer conductor 3 and enters the channel 5 formed in the annular conductor 6, flows through the length of the annular conductor 6 and enters the hollow center of the inner conductor 2, rises the length of the inner conductor 2, and flows back into the tank, thereby cooling the primary conductor 1.

The structure of the conventional current transformer illustrated in FIG. 1 has the drawback that the primary conductor 1 comprises three separate members (the inner conductor 2, the outer conductor 3, and the annular conductor 6) which must be assembled and then joined to one another by the labor-intensive processes of welding or brazing, which increase manufacturing costs. Furthermore, at the connection between the bottom ends of the inner conductor 2 and the outer conductor 3 and the annular conductor 6, the flow path of the dielectric fluid bends 90 degrees since the ends of the annular conductor 6 are at right angles to the bottom ends of the inner and outer conductors. These 90-degree bends increase the resistance to flow, with the result that the circulation of the dielectric fluid is decreased and the cooling effect provided thereby may be inadequate. Furthermore, as the dielectric fluid can not flow smoothly past these sharp bends, there are regions within the fluid in the vicinity of the bends in which the fluid is largely stagnant, providing almost no cooling effect and resulting in the localized heating of the conductors.

SUMMARY OF THE INVENTION

It is an object of the present invention to provide a self-cooled current transformer of the type which is cooled by the circulation of a dielectric fluid which has a simpler structure than a conventional current transformer of this type.

It is another object of the present invention to provide a current transformer which is simpler and less expensive to manufacture than a conventional self-cooled current transformer.

It is yet another object of the present invention to provide a current transformer in which the circulation of a dielectric fluid therethrough is increased.

A current transformer according to the present invention has an electrically-conducting tube which is bent at its center so as to form a loop which is continuous with two parallel straight portions of different lengths. The loop functions as a primary winding and the straight portions function as leads therefor. The tube has a longitudinally-extending fluid-carrying passageway formed at its center for its entire length. The ends of the tube are open and communicate with the inside of a reservoir for a dielectric fluid which can flow through the tube. An electrically-insulating member, which serves as means for decreasing the cross-sectional area of the fluid-carrying passageway in one of the straight portions, is longitudinally inserted into the fluid-carrying passageway of one of the straight portions of the tube. By decreasing the cross-sectional area of the fluid-carrying passageway, it increases the flow resistance in that straight portion. The increase in flow resistance produces a temperature difference in the dielectric fluid within the two straight portions of the tube, promoting circulation of the dielectric fluid by convection.

BRIEF DESCRIPTION OF THE DRAWINGS

In the drawings, the same reference numerals indicate the same or corresponding parts.

DESCRIPTION OF THE PREFERRED EMBODIMENTS

Figure 5:
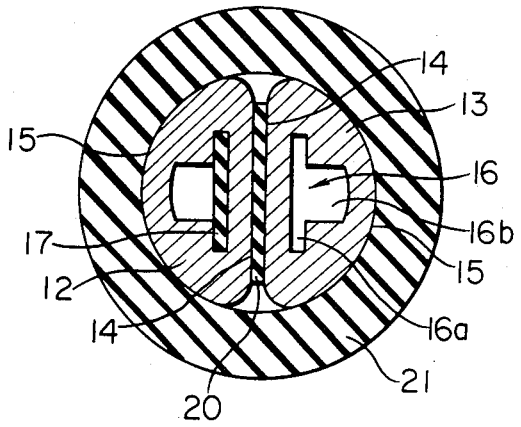
FIG. 5 is a transverse cross-sectional view of the same embodiment taken along Line V—V of FIG. 4.
Figure 6:
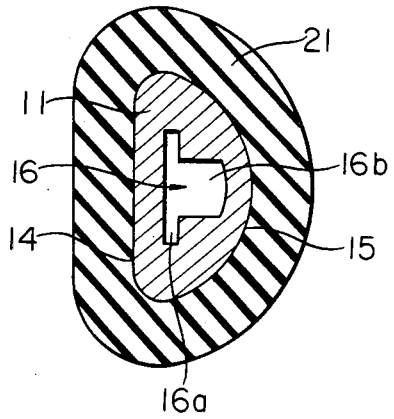
FIG. 6 is a transverse cross-sectional view taken along Line VI—VI of FIG. 4.

Hereinbelow, a preferred embodiment of the present invention will be described while referring to FIGS. 4 through 6 of the accompanying drawings.

Figure 4:
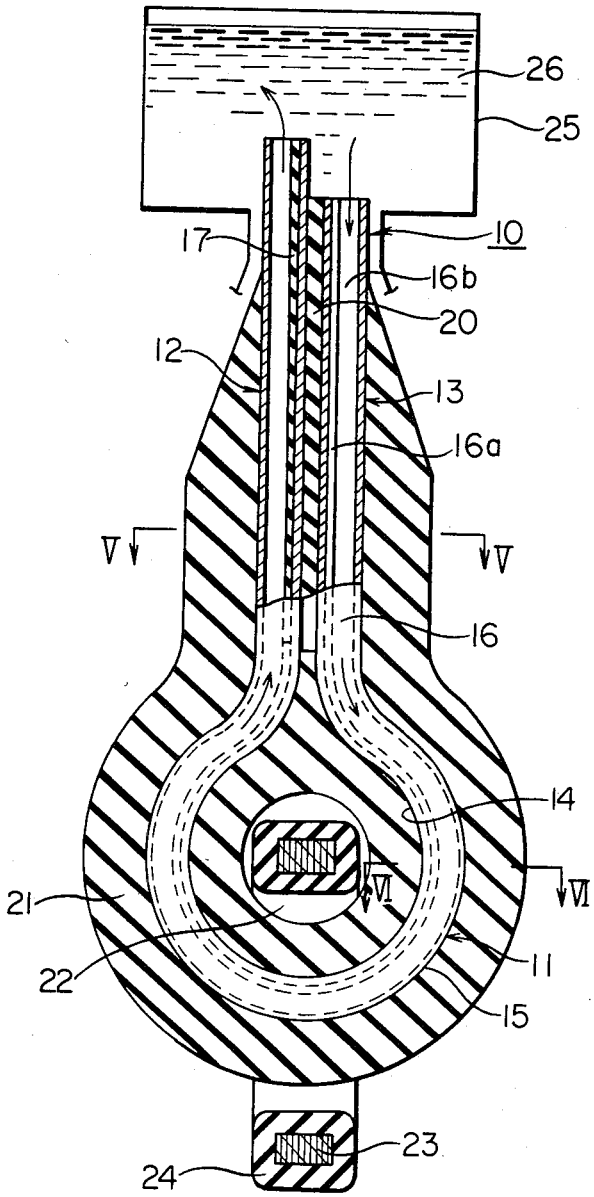
FIG. 4 is a vertical cross-sectional view of an embodiment of a current transformer according to the present invention.

As shown in FIG. 4, which is a vertical cross-sectional view of this embodiment, the primary winding and the leads therefor of a current transformer according to the present invention are formed from a single open-ended tube 10. The tube 10 is made from an electrically-conducting material having a constant cross-sectional shape. Although there is no particular restriction on the cross-sectional shape of the tube 10, in the present embodiment, as shown in FIGS. 4 and 5, its cross-sectional outline resembles a Quonset hub, the outer surface of the tube 10 having a flat portion 14 and a curved portion 15. The thickness of the walls is chosen so as to obtain a suitable current density. At the center of the tube 10 is a longitudinally-extending fluid-carrying passageway 16 having generally the shape of a T. The fluid-carrying passageway 16 comprises a thin but wide plate-inserting portion 16*a* which is parallel to the flat portion 14 of the tube 10, and a main channel portion 16*b* which is narrower than the plate-inserting portion 16*a* and extends perpendicularly therefrom towards the curved portion 15 of the tube 10. The plate-inserting portion 16*a* is for the insertion of a plate 17 which will be described further on.

Figure 1:
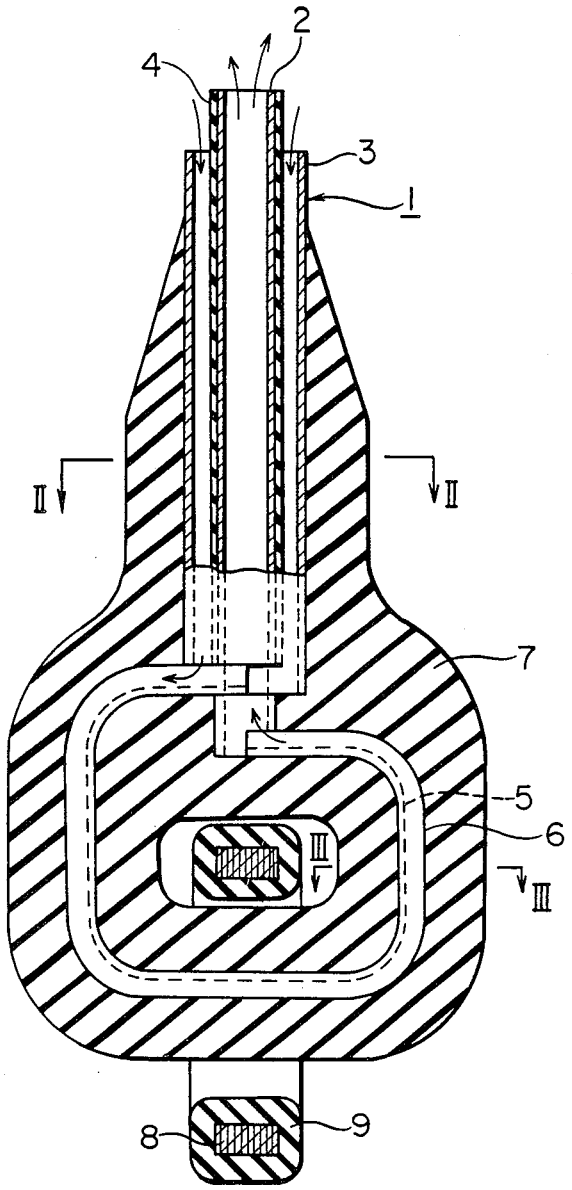
FIG. 1 PRIOR ART
FIG. 1 is a vertical cross-sectional view of a conventional current transformer of the type cooled by a circulating dielectric fluid.
Figure 2:
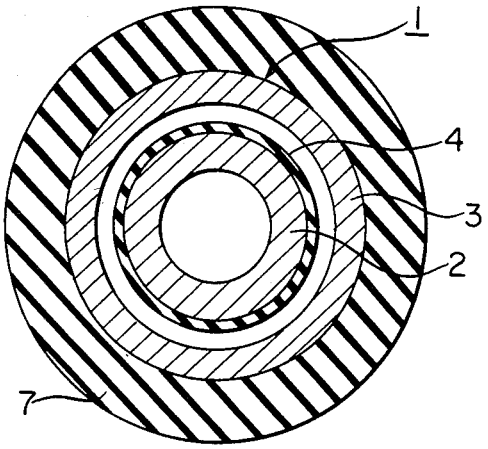
FIG. 2 PRIOR ART
FIG. 2 is a transverse cross-sectional view taken along Line II—II of FIG. 1.
Figure 3:
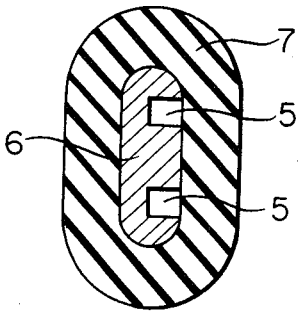
FIG. 3 PRIOR ART
FIG. 3 is a transverse cross-sectional view taken along Line III—III of FIG. 1.

The tube 10, which is initially straight, is bent at approximately midway along its length by a conventional bending process so as to form a loop 11 having a prescribed radius, with the flat portion 14 of the tube 10 facing towards the center of the loop 11. This loop 11 corresponds to the annular conductor 6 of the conventional current transformer illustrated in FIG. 1 and functions as a primary winding. The ends of the loop 11 smoothly connect with two straight portions 12 and 13 forming the end sections of the tube 10. These straight portions 12 and 13 function as leads for the primary winding. The tube 10 is bent so that the straight portions 12 and 13 are parallel and slightly separated with their flat portions 14 confronting one another. The two straight portions 12 and 13 are electrically insulated from one another by an electrically-insulating plate 20 which is longitudinally disposed therebetween, the plate 20 having roughly the same width as the flat portions 14 and roughly the same length as the parallel sections of the straight portions 12 and 13. The tube 10 is oriented such that the straight portions 12 and 13 extend vertically upwards from the loop 11. In the present embodiment, the tube 10 is bent into a single loop 11, but it is possible to bend the tube 10 so as to form a plurality of concentric loops 11.

The open, upper ends of both straight portions 12 and 13 are disposed within a reservoir 25 which contains a conventional dielectric fluid 26 such as an electrically-insulating oil. The end of one straight portion 12 is somewhat higher than that of the other straight portion 13. The height of the dielectric fluid 26 in the reservoir 25 is such that both of the upper ends of the straight portions are always submerged. The upper ends of the straight portions 12 and 13 are electrically connected to unillustrated terminals of leads which pass through the reservoir 25.

An electrically-insulating plate 17 made of a material such as Bakelite or pressboard is longitudinally inserted into the plate-inserting portion 16*a* of the T-shaped fluid-carrying passageway 16 of the longer straight portion 12. The plate 17 has the same width and thickness as the plate-inserting portion 16*a* so as to fit snugly therein without moving, and its length is substantially the same as that of straight portion 12. The plate 17 serves as means for decreasing the cross-sectional area of the fluid-carrying passageway 16 of straight portion 12 with respect to that of straight portion 13. As a result of the decrease in cross-sectional area, the flow resistance of straight portion 12 is increased.

The tube 10 is surrounded by main insulation 21 in the form of electrically-insulating paper which is wrapped around the tube 10 and secured thereto by taping. In the straight portions 12 and 13, the insulation 21 contacts only the curved portions 15 of the tube 10, while in the loop 11, the insulation 21 contacts both the flat portions 14 and the curved portions 15. A through hole 22 is formed in the insulation 21 at the center of the loop 11, and a laminated core 23 which is interlinked with the loop 11 passes through this hole 22. A secondary winding 24 having a prescribed number of turns is wrapped around the laminated core 23. The secondary winding 24 is electromagnetically coupled with the loop 11, which functions as the primary winding, so that a current passing through the primary winding will induce a secondary current in the secondary winding 24. Although not shown in FIG. 4, the lower portion of the reservoir 25 surrounds the tube 10, the laminated core 23, and the secondary winding 24, and all three are immersed in the dielectric fluid 26. Accordingly, the electrically-insulating paper which is used for the main insulation 21 must be suitable for immersion in the dielectric fluid 26.

During the operation of a current transformer according to the present invention, the fluid-carrying passageway 16 in the tube 10 is filled with the dielectric fluid 26. The heat produced by the current passing through the tube 10 heats the dielectric fluid 26 therewithin, and convection causes it to rise. Due to the provision of the plate 17 within straight portion 12, the flow resistance of straight portion 12 is greater than that of straight portion 13, and the temperature of the dielectric fluid 26 in straight portion 12 becomes greater than that in straight portion 13. As a result of this temperature difference, the dielectric fluid 26 is caused to circulate by convection through the tube 10 in the direction shown by the arrows, thereby cooling the tube 10. Namely, cool dielectric fluid 26 from the bottom of the reservoir 25 enters straight portion 13, flows down it and through the loop 11, flows up through straight portion 12, is discharged into the reservoir 25, and rises to the top thereof. As the tube 10 has no sharp bends formed in it, the dielectric fluid 26 can circulate smoothly therethrough, providing a better cooling effect than is possible in a conventional current transformer. Furthermore, as there are no areas within the tube 10 where the dielectric fluid 26 remains stagnant, the tube 10 can be adequately cooled without the formation of any localized hot areas.

In the present embodiment, the means for decreasing the cross-sectional area of the fluid-carrying passageway 16 in one of the straight portions is in the form of a rectangular plate 17. However, any shape which enables a partial reduction of the cross-sectional area is possible. For example, the fluid-carrying passageway 16 in the tube 10 could have a circular cross-section, and the means for decreasing the cross-sectional area could be in the form of a hollow, electrically-insulating tube which is inserted longitudinally into the passageway 16, the outer diameter thereof corresponding to the inner diameter of the passageway 16 so as to snugly fit into the passageway 16.

As a current transformer according to the present invention employs a single tube 10 to form the primary winding and the leads therefore, it has the advantages over a conventional current transformer that it requires the manufacture of fewer parts and that there is no need to perform connecting operations such as welding or brazing. Accordingly, it can be assembled at much less expense than a conventional current transformer.

What is claimed is:

1. A current transformer comprising:

an open-ended electrically-conducting tube having a longitudinally-extending fluid-carrying passageway formed in its center, said tube being bent so as to form at least one loop at the midportion thereof and two straight portions at the ends thereof, said loop serving as a primary winding and said straight portions serving as leads for said primary winding, said straight portions being vertically disposed above said loop;

a core which is interlinked with said loop in said tube;

a secondary winding which is wrapped around said core and which is electromagnetically coupled with said primary winding when current is passed through said primary winding;

a reservoir for dielectric fluid which is disposed above said straight portions of said tube, the open ends of said straight portions being in fluid communication with the inside of said reservoir; and means for decreasing the cross-sectional area of the fluid-carrying passageway in one of said straight portions of said tube with respect to the cross-sectional area of the fluid-carrying passageway in the other of said straight portions, said means for decreasiing having a transverse cross-sectional area being less than that of said fluid-carrying passageway and being inserted lengthwise into said fluid-carrying passageway of one of said straight portions.

* * * * *